US005190414A

United States Patent [19]

Bemmerl et al.

[11] Patent Number: 5,190,414

[45] Date of Patent: Mar. 2, 1993

[54] WALKING PROP FOR MINE TUNNELS

[75] Inventors: Hans-Ferdinand Bemmerl, Herne; Alois Scheunert, Recklinghausen; Peter Kröninger, Gelsenkirchen; Peter Rose; Alfred Bollmann, both of Bochum, all of Fed. Rep. of Germany

[73] Assignee: Strebtechnik Bochum GmbH & Co., Bochum, Fed. Rep. of Germany

[21] Appl. No.: 863,562

[22] Filed: Apr. 3, 1992

[30] Foreign Application Priority Data

Apr. 3, 1991 [DE] Fed. Rep. of Germany ..... 4110681

[51] Int. Cl.[5] ..... E21D 23/10

[52] U.S. Cl. ..... 405/296; 405/297; 405/299

[58] Field of Search ..... 405/291, 295, 296, 297, 405/299; 299/31, 33

[56] References Cited

U.S. PATENT DOCUMENTS

| | | | |
|---|---|---|---|
| 3,811,288 | 5/1974 | Wehner et al. | 405/296 |
| 4,600,340 | 7/1986 | Rosenberg | 405/297 |
| 5,039,257 | 8/1991 | Bithell | 405/297 |
| 5,100,263 | 3/1992 | Woodford et al. | 405/297 |

FOREIGN PATENT DOCUMENTS

3400771A1 7/1985 Fed. Rep. of Germany .

*Primary Examiner*—David H. Corbin
*Attorney, Agent, or Firm*—Herbert Dubno

[57] ABSTRACT

A walking mining prop has a skid-lifting assembly in the region of the ram which braces the roof cap with respect to the skid formed by a bridge from which lifting cylinders are articulated and suspended. The pistons of these lifting cylinders are articulated to a pressure plate which at least partly surrounds the guide rods of a guide-rod assembly on which the skid is guided, a mechanism being provided to advance the skid relative to the guide-rod assembly.

10 Claims, 3 Drawing Sheets

WALKING PROP FOR MINE TUNNELS

FIELD OF THE INVENTION

Our present invention relates to a walking prop for a mine tunnel and, more particularly, to a mine prop of the type in which a roof cap is pressed against the tunnel roof by at least one hydraulic ram on a skid which is provided with a mechanism for stepping that skid along the floor of the mine tunnel.

BACKGROUND OF THE INVENTION

In mining operations, it is common to provide a walking-prop system which comprises a skid which can be advanced along the floor of the tunnel substantially in the cadence of advance and the mining or excavating machine to follow the recession of the mining face, the walking prop having hydraulic rams which can press a roof cap against the roof of the tunnel. The roof cap generally extends forwardly of the skid and the ram to have a cantilevered portion which can overhang the mining machine and protect it from falling rock from the tunnel roof The rear side or goaf side of the prop can be provided with a shield, hereinafter referred to as a goaf-side shield, which can be articulated to the roof cap and to the skid.

The mechanism for advancing the skid, which can be provided in two skid parts laterally spaced from one another, can include a guide-rod assembly extending in the direction of displacement of the skid and anchored, for example, to a conveyor for the mining debris and the excavating machine, and a stepping hydraulic piston-and-cylinder assembly which can advance the skid against the guide-rod assembly.

In conventional operations, the mining machine and conveyor is advanced to follow the cutting away of the mining face or wall, drawing the guide-rod assembly in the forward direction.

When the guide-rod assembly is fully extended forwardly, the rams are retracted somewhat so that the prop is no longer braced against the roof, and the stepping mechanism is actuated to shift the skid along the guide-rod assembly, thereby causing the prop to move in the direction of the conveyor and mining machine. The hydraulic ram then presses the cap against the roof so that the prop is braced between the floor and the roof. A series of props can be provided along the wall which is mined in long-wall mining, as may be desired.

The device may be provided with a skid-lifting cylinder which causes the front end or leading end of the skid to tilt upwardly for advance of the skid, thereby preventing interference with such advance by irregularity in the ground.

When reference is made herein to a horizontal skid, we preferably intend to describe a divided skid, namely, a skid which is composed of two laterally-spaced but parallel parts which may be interconnected by a traverse. The stepping cylinder can be located between the two parts of the skid and, just as the reference to a horizontal skid is intended to include one-part and two-part skids, references to the cap, and the goaf-side shield may refer to one-piece and two-piece caps and shields. The journals and articulations of these elements can be traverses as well.

In the past, the lifting mechanism have been designed to lift the leading end of the one-piece skid or to lift the leading ends or the separate skid parts when the latter together form the skid.

In earlier systems as well, the guide-rod assembly had a goaf-side end pivotally connected by a traverse to the stepping cylinder assembly. Because of spatial requirements, the skid-lifting cylinder arrangement was horizontally oriented in the region of the ram and connected via a lever transmission to the guide-rod assembly. As a result of this orientation, the lifting movement was effected with a relatively short lever arm and unsatisfactory force-transmission characteristics. As a result, the mechanism was strained and could suffer breakdown, the lifting stroke was limited and by and large, the system was found to be unsatisfactory.

OBJECTS OF THE INVENTION

It is, therefore, the principal object of the present invention to provide a walking or powered prop for mining purposes which without major reconstruction over earlier systems, is able to avoid the drawbacks outlined above.

More specifically, it is an object of the invention to provide a walking prop with improved force transmission for the skid lifting action.

It is also an object of the invention to provide an improved walking prop which obviates the drawbacks of the systems previously employed.

SUMMARY OF THE INVENTION

These objects are attained, in accordance with the invention, in a walking prop for a mine which comprises:

a substantially horizontal skid having a horizontal surface adapted to ride along a floor of a mine tunnel;

at least one hydraulic ram on the skid;

a roof cap operatively connected to the ram and extending in a forward direction of advance of the walking prop from the ram and adapted to be braced against a roof of the tunnel;

a goaf-side shield rearwardly of the roof cap and articulated thereto;

a lever linkage connecting the shield to the skid and provided with forwardly disposed and goaf-side links;

a stepping mechanism for advancing the skid along the floor and including:

a guide-rod assembly having a pair of generally horizontal guide rods along which the skid is guided, and a stepping piston-and-cylinder assembly braced between the guide-rod assembly and the skid for shifting the skid relative to the guide-rod assembly; and a lifting piston-and-cylinder assembly acting upon the skid in a region of the ram and including:

a lifting bridge secured to laterally opposite sides of the yoke, a pair of lifting cylinders having respective cylinder members and respective piston members, one of the members of each lifting cylinder being pivotally connected to and suspended from the lifting bridge, and a pressure plate pivotally connected to another member of each of the lifting cylinders and formfittingly engaging around the guide rods to enable at least a forward end of the skid to be lifted from the floor by operation of the lifting cylinders for advance of the skid along the floor.

In the system of the invention, therefore, the lifting cylinders are pivotally suspended from the bridge and the piston rods thereof are braced downwardly against and are articulated to a pressure plate which reaches around and formfittingly engages the guide rods of the assembly.

Thus the skid lifting is effected by pressing the bridge away from the guide rods directly therebelow without the intervention of any lever transmission which may have undesirable lever ratios or characteristics which might detrimentally affect the force transmission.

The piston-and-cylinder assemblies can be secured against pressure overloads in both the compression and tension directions by simple and conventional control, such as pressure-relief valves connected directly to the cylinder. The elimination of the lever mechanism also results in significant simplification, reduced maintenance, etc.

According to a feature of the invention, which is especially applicable to divided skids, i.e. skids having two skid halves which can be advanced separately from one another in a walking pattern, or where the skid halves are coupled together for movement jointly, the lifting bridge can be provided on lateral cheeks: or flanges of the skid halves.

Especially effective force transmission is achieved when the pressure plate is disposed substantially vertically beneath the lifting bridge. The cylinders of the lifting piston-and-cylinder assembly are advantageously connected to the lifting bridge by pin-type articulations or joints while the piston rods are connected to the pressure plate via pan-type or ball-type joints or swivels Of course, it is also possible to provide an embodiment in which the piston rods are connected to the lifting bridge while the cylinders are pivotally connected to the pressure plate.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
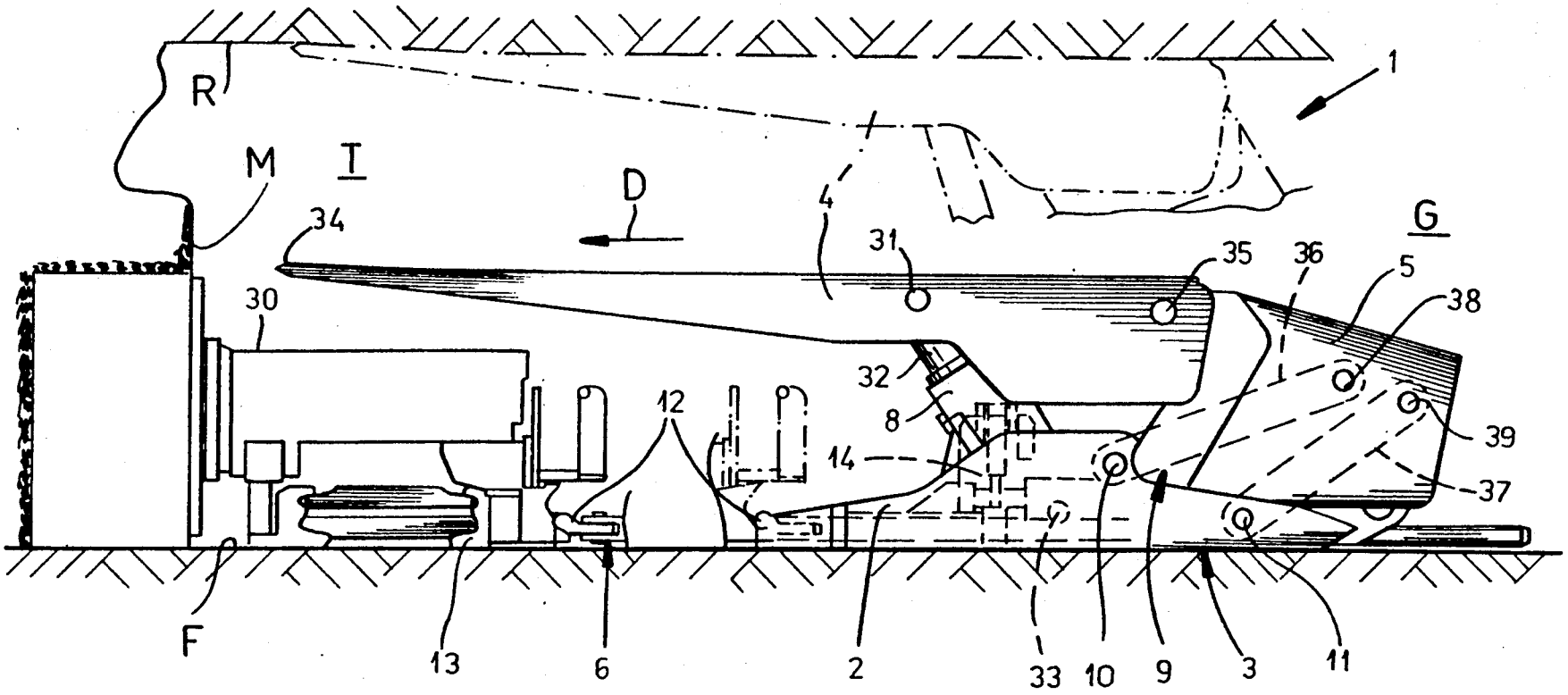
FIG. 1 is a diagrammatic side elevational view of a walking prop according to the invention.

The walking or powered mine prop shown in the drawing at 1 is intended to support the roof R of a mine tunnel or gallery T having a floor F and a mining face M which is removed by a mining machine represented at 30 only diagrammatically in the drawing and shiftable along the long wall face perpendicular to the plane of the drawing in FIG. 1.

The mine prop 1 comprises a horizontal skid 2 with a supporting surface 3 and a roof cap 4 which is pivotally connected at 31 to a hydraulic ram 32 whose cylinder is shown at 8 and which is pivoted on a pivot 33 on the skid 2.

The ram and cylinder 32, 8 seen in FIG. 1 may be one of two such rams, each of which is pivotally connected to a respective skid half 2*a*, 2*b* when a bifurcated skid 2 is used as is the case in the preferred embodiment and has been illustrated.

The end 34 of the cap 4 which overhangs the mining machine, protects the machine and the operator from falling roof debris. As is also apparent from FIG. 1, by extension and contraction of the ram 32, 8, the cap can be raised to press against the roof R or lowered to liberate the walking prop and enable it to advance in the direction D of forward travel. The region behind the prop 1 in the tunnel T is represented at G and constitutes the goaf.

In addition, the walking prop 1 has a goaf-side shield 5 which may be pivotally connected at 35 to the cap 4 and is connected to the skid 2 by a lever transmission represented at 9 and includes links 36 and 37 pivotally connected at 10 and 11 to the skid 2. These pivots 10 and 11 are respectively and forwardly disposed pivot and goaf-side pivots.

Similarly, links 36 and 37 are pivotally connected at 38 and 39 at a forward pivot and a goaf-side pivot to the shield 5.

The walking prop 1 also comprises a stepping mechanism 6, 7 having a guide-rod assembly 6 and a stepping piston-and-cylinder assembly 7.

The piston-and-cylinder assembly 7 can include a piston rod 40 which can be articulated at 41 to a bracket 42 connected to the head 12 of the guide-rod assembly 2 which, in turn, is linked to a transverse conveyor 13 displaceable along the mining face M for carrying away the mined rock.

The head 12, further, advances with the mining machine.

The cylinder 43 of the assembly 7 can be pivotally connected at 44 to a yoke 45 engaged by pistons 46 and 47 of additional horizontal cylinders 48 and 49 of the skid halves 2*b* and 2*c* and which can also be actuated to draw the skid 2 toward the conveyor 3 when the cap is retracted into its solid-line position shown in FIG. 1.

In the embodiment illustrated and in the preferred embodiment, as has been indicated, the horizontal skid is a two-part skid with two distinct skid parts 2*a* and 2*b*, between each of which and the cap 4, a respective hydraulic ram 32, 8 is provided.

The pivots 10 and 11 are located at each side of the skid 2.

The skid 2 is guided on the guide-rod assembly 6.

In addition, a skid-lifting piston-and-cylinder assembly 14 is provided in the region of the hydraulic ram 8. This assembly can be seen best from FIGS. 2–4.

The skid-lifting assembly 14 comprises a lifting bridge 15 connected to the horizontal skid 2.

Figure 2:
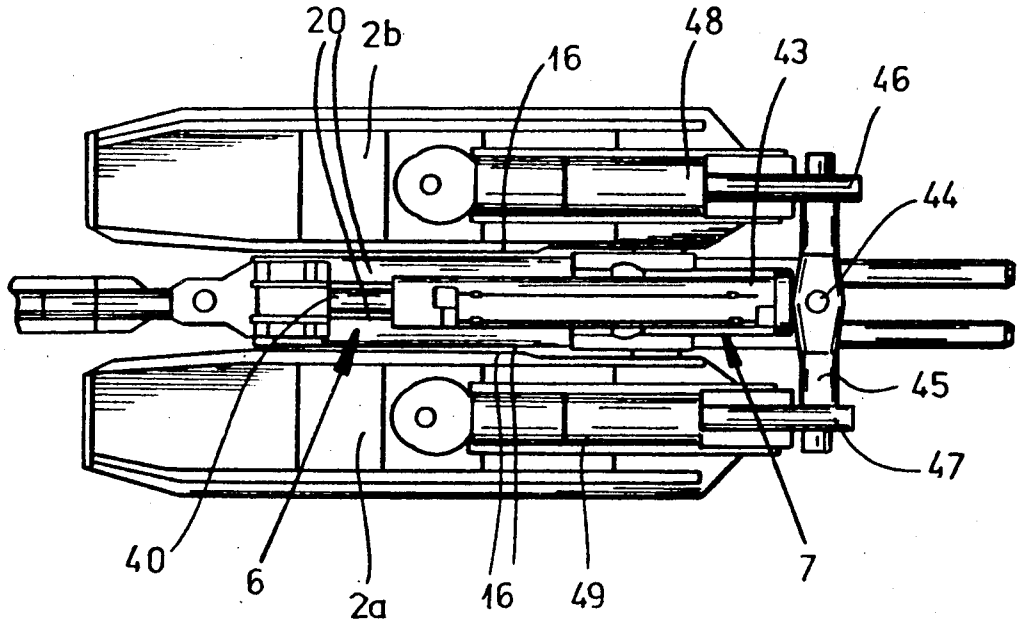
FIG. 2 is a plan view of a portion of the stepping mechanism of the walking prop of FIG. 1.
Figure 3:
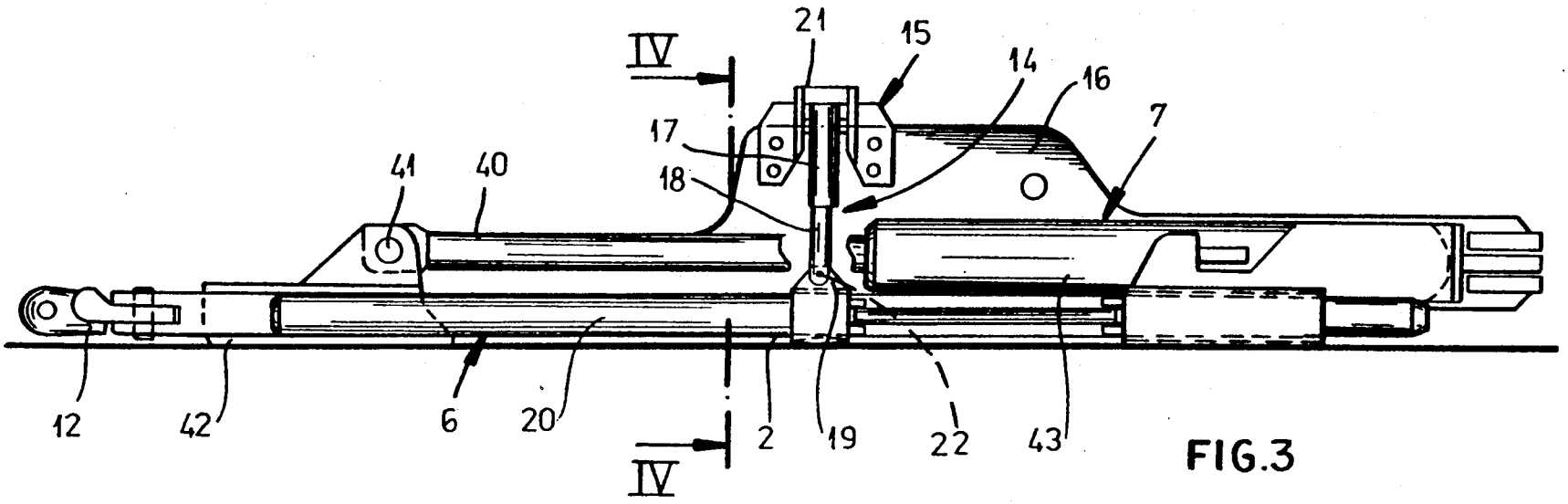
FIG. 3 is a side view, partly broken away, of the walking mechanism of the skid of FIG. 2 in another operative position by comparison to FIG. 2.
Figure 4:
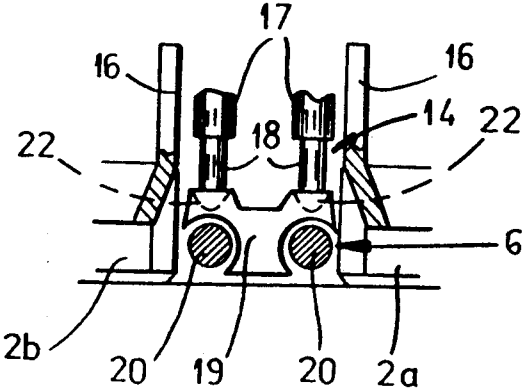
FIG. 4 is a sectional view taken along the line IV—IV of FIG. 3 but with the stepping mechanism omitted so as not to obscure the lifting assembly.

From FIGS. 2–4 it will be apparent that the two skid halves 2*a* and 2*b* have lateral flanges or cheeks 16 on which the lifting bridge 15 is affixed. On the lifting bridge 15, the cylinders 17 are pivotally suspended. The piston rods 18 of the lifting cylinders are pivotally connected to a pressure plate 19 which formfittingly surrounds the guide rods 20 of the guide-rod assembly 6 (see FIG. 3 and 4).

In a preferred embodiment of the invention, the pressure plate 19 lies in a vertical plane and is disposed vertically beneath the lifting bridge 15 so that the cylinders 17 and their piston rods 18 also lie in vertical planes. The cylinders 17 are connected to the lifting bridge 15 with the aid of pin articulations or joints 21. The piston rods 18 of these cylinders are connected to the pressure plate 19 by pan-type joints or ball joints forming swivels and represented at 22.

We claim:

1. A walking prop for a mine, comprising:

a substantially horizontal skid having a horizontal surface adapted to ride along a floor of a mine tunnel;

at least one hydraulic ram on said skid;

a roof cap operatively connected to said ram and extending in a forward direction of advance of said walking prop from said ram and adapted to be braced against a roof of said tunnel;

a goaf-side shield rearwardly of said roof cap and articulated thereto;

a lever linkage connecting said shield to said skid and provided with forwardly disposed and goaf-side links;

a stepping mechanism for advancing said skid along said floor and including:

a guide-rod assembly having a pair of generally horizontal guide rods along which said skid is guided, and a stepping piston-and-cylinder assembly braced between said guide-rod assembly and said skid for shifting said skid relative to said guide-rod assembly; and a lifting piston-and-cylinder assembly acting upon said skid in a region of said ram and including:

a lifting bridge secured to laterally opposite sides of said yoke, a pair of lifting cylinders having respective cylinder members and respective piston members, one of the members of each lifting cylinder being pivotally connected to and suspended from said lifting bridge, and a pressure plate pivotally connected to another member of each of said lifting cylinders and formfittingly engaging around said guide rods to enable at least a forward end of said skid to be lifted from said floor by operation or said lifting cylinders for advance of said skid along said floor.

2. The walking prop defined in claim 1 wherein said skid is bifurcated and comprises two skid parts, each of which is formed with a lateral cheek, said lifting bridge being affixed to said cheeks.

3. The walking prop defined in claim 2 wherein said pressure plate is disposed substantially vertically below said lifting bridge.

4. The walking prop defined in claim 3 wherein said cylinder members are pivotally connected with said lifting bridge by pin-type articulations.

5. The walking prop defined in claim 4 wherein said piston members are piston rods connected to said pressure plate by pan-type joints.

6. The walking prop defined in claim 4 wherein said piston members are piston rods connected to said pressure plate by ball joints.

7. The walking prop defined in claim 1 wherein said pressure plate is disposed substantially vertically below said lifting bridge.

8. The walking prop defined in claim 1 wherein said cylinder members are pivotally connected with said lifting bridge by pin-type articulations.

9. The walking prop defined in claim 1 wherein said piston members are piston rods connected to said pressure plate by pan-type joints.

10. The walking prop defined in claim 1 wherein said piston members are piston rods connected to said pressure plate by ball joints.

* * * * *